US007513375B2

(12) United States Patent
Wenzler

(10) Patent No.: US 7,513,375 B2
(45) **Date of Patent: *Apr. 7, 2009**

(54) HANGING DEVICE

(76) Inventor: Michael James Wenzler, 1025 W. Rahn, Dayton, OH (US) 45429

( * ) Notice: Subject to any disclaimer, the term of this patent is extended or adjusted under 35 U.S.C. 154(b) by 414 days.

This patent is subject to a terminal disclaimer.

(21) Appl. No.: 11/162,137

(22) Filed: Aug. 30, 2005

(65) Prior Publication Data

US 2006/0011671 A1 Jan. 19, 2006

Related U.S. Application Data

(63) Continuation-in-part of application No. 10/853,515, filed on May 25, 2004, now Pat. No. 7,100,774, which is a continuation-in-part of application No. 10/758,556, filed on Jan. 15, 2004, now Pat. No. 6,964,342.

(51) Int. Cl.
*A47F 7/16* (2006.01)
*B42F 1/00* (2006.01)

(52) U.S. Cl. ..... 211/45; 211/52; 211/113; 211/124

(58) Field of Classification Search ..... 211/45, 211/113, 86.1, 55, 96, 89.01, 124, 49.1, 52; 223/90, 91, 93, 96; 206/278–300, 8, 9, 11; 40/652; 248/316.1–316.3, 316.5, 316.7
See application file for complete search history.

(56) References Cited

U.S. PATENT DOCUMENTS

| | | | |
|---|---|---|---|
| 639,875 | A | 12/1899 | Wagner |
| 1,081,848 | A | 12/1913 | MacDonald |
| 1,634,532 | A | 7/1927 | Bowe |
| 2,261,005 | A | 10/1941 | Thomson |
| 2,496,531 | A | 2/1950 | Gray |
| 2,524,537 | A | 10/1950 | Osmonson |
| 2,527,484 | A | 10/1950 | Lester |
| 2,779,114 | A | 1/1957 | Orthwine |
| 2,987,193 | A | 6/1961 | Pajor |
| 3,123,331 | A | 3/1964 | Field |
| 3,214,810 | A | 11/1965 | Mathison |
| 3,235,928 | A | 2/1966 | Clark |
| D204,134 | S | 3/1966 | Duncan |
| 3,624,873 | A | 12/1971 | Frey |
| 3,698,607 | A | 10/1972 | Batts |
| 3,767,092 | A | 10/1973 | Garrison |
| 3,946,915 | A | 3/1976 | Crane |
| 3,953,065 | A | 4/1976 | Shannon |
| 3,982,307 | A | 9/1976 | Smith |
| 4,010,517 | A | 3/1977 | Kapstad |
| 4,023,721 | A | 5/1977 | Erthein |
| 4,194,635 | A | 3/1980 | Ferrara |
| 4,723,665 | A | 2/1988 | Benedict |
| 4,763,390 | A | 8/1988 | Rooz |
| 4,830,322 | A | 5/1989 | Gary |
| 4,899,974 | A | 2/1990 | Wear |

(Continued)

*Primary Examiner*—Jennifer E. Novosad
(74) *Attorney, Agent, or Firm*—R. William Graham

(57) ABSTRACT

A hanging device has a base that can be connected to a wall, a plurality of horizontally disposed retainers extend across a front face of the base, wherein each retainer includes a pair of retainer members which are biased toward one another and the members are configured to be movably displaced from one another to readily permit the insertion of an article to be hung, such as a garment, therebetween.

16 Claims, 16 Drawing Sheets

U.S. PATENT DOCUMENTS

| | | | | |
|---|---|---|---|---|
| 5,318,174 | A | 6/1994 | Zoroufy | |
| 5,535,896 | A | 7/1996 | Morgan | |
| 6,021,907 | A | 2/2000 | OBrien | |
| 6,021,933 | A | 2/2000 | Zuckerman | |
| 6,257,422 | B1 | 7/2001 | Rois | |
| 6,481,585 | B1 | 11/2002 | Cloughton | |
| 6,547,200 | B2 | 4/2003 | Dilworth | |
| 6,964,342 | B2 * | 11/2005 | Wenzler | 211/45 |
| 7,100,774 | B2 * | 9/2006 | Wenzler | 211/45 |

* cited by examiner

Fig. 3
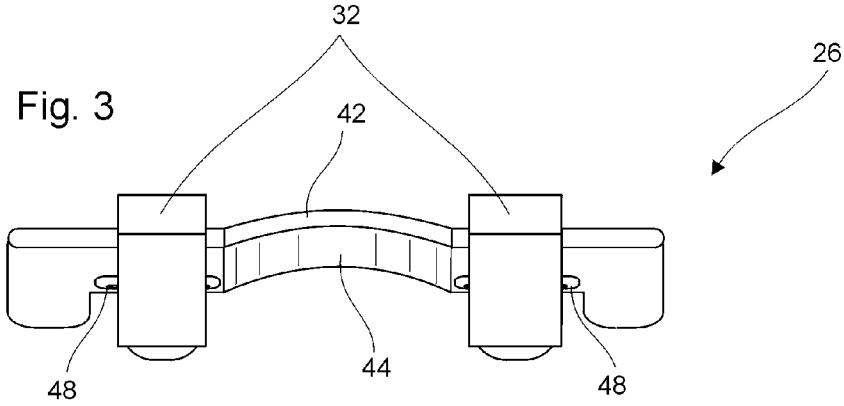
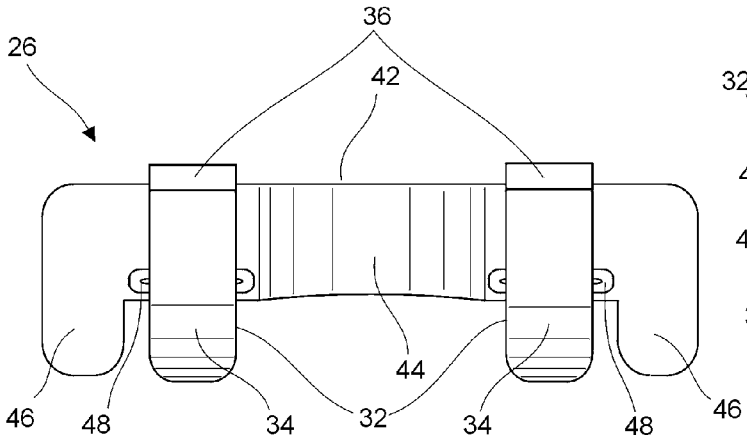
Fig. 4
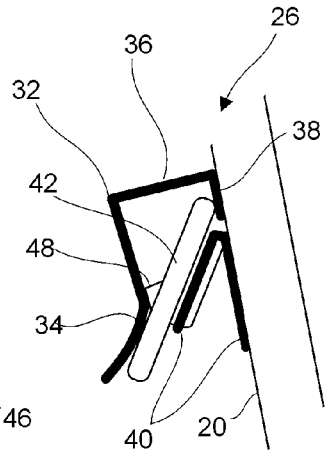
Fig. 5
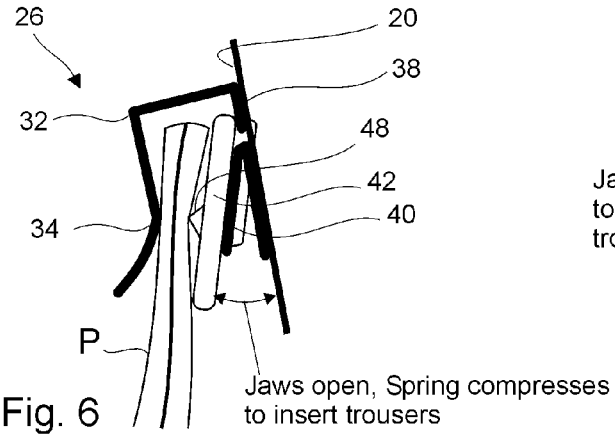
Fig. 6
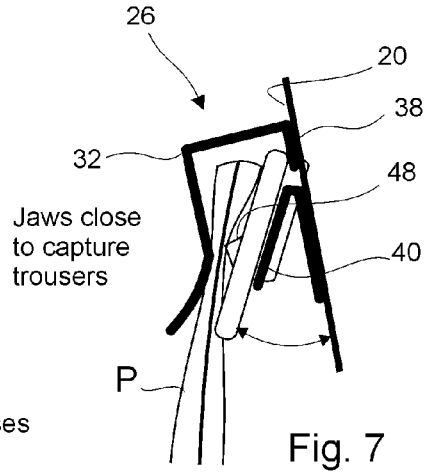
Fig. 7

HANGING DEVICE

This is a continuation-in-part of U.S. Ser. No. 10/853,515 filed May 25, 2004 now U.S. Pat. No. 7,100,774 which was a continuation-in-part of U.S. Ser. No. 10/758,556 filed Jan. 15, 2004 now U.S. Pat. No. 6,964,342 and the present invention claims the benefit of said applications.

BACKGROUND OF THE INVENTION

Field of the Invention

This invention is generally related to organizers and holders and more particularly to a device to hang a plurality of trousers or the like in a limited space.

Conventional hangers for trousers, skirts and the like ordinarily hold a single garment with a horizontal bar and a top hook for hooking over a closet rod. In many cases, the number of garments that need to be stored exceeds the space or hangers available. This has led to the development of several prior art devices which attempt to provide solutions in maximizing clothes storage.

Such organizers include telescoping supports or racks or pivoting racks which mount to a closet wall or an existing closet horizontal bar. Other prior racks and hanging devices pertinent hereto include a vertically extending post from which a plurality of vertically spaced horizontal support arms are pivotally connected enabling pairs of pants, skirts and other types of clothing to be suspended therefrom. When the clothes are hung on these arms, they are radially spaced and take on a helical pattern. Some of these include telescoping brackets for anchoring the organizers to the wall of a closet.

While there have been some advances in maximizing closet storage, there remains a need to provide an improved clothes hanging device which conserves more closet space, is simpler to use and reliably retains garments in a non-wrinkling manner.

BRIEF SUMMARY OF THE INVENTION

It is an object of the invention to provide a device for hanging clothes.

It is another object to maximize closet space.

It is still another object to provide the ability to hang a plurality of garments (trousers and the like) in a limited space without the trousers or the like being wrinkled.

It is another object that to permit access to any one of the selected garments without the need to move hangers for the remainder of the plurality.

The device of the invention includes an elongated base which can be connected to a vertical support or wall, with its long axis of the base vertically disposed. A plurality of horizontally disposed retainers extend across a front face of the base, wherein each retainer includes a pair of retainer members which are biased toward one another. The members are configured to be movably displaced from one another to readily permit the insertion of an article to be hung, such as a garment, therebetween.

When the base is connected to the wall, the front face can be configured to be set at an angle with an upper part of the base further displaced from the wall than a lower part of the base. For example, when pant bottoms are hung from the retainers, the uppermost hung pants hang highest and are most displaced from the wall. The retainers are arranged one atop the other and spaced apart from one another so that there is enough space to accommodate a pair of pants, for example, in a plane. By loading the garments as shown and described herein, the user may access any single item by pulling the pants downward simply releasing the tension of the bias between any selected pair of retaining members. The garment may then be removed without disturbing any of the others. Various means are provided to secure the base to a support within a closet.

These and other objects, advantages and features of the invention will become more apparent when the detailed description is studied in conjunction with the drawings.

BRIEF DESCRIPTION OF THE DRAWINGS

FIG. 5C is a top view of the embodiment in FIG. 1A.

FIG. 3 is a top perspective view of a retainer shown in FIG. 4.

FIG. 4 is a front view of retainer in FIG. 3.

FIG. 5 is a side view of a retainer of the present invention.

FIG. 6 is a side view of the retainer of FIG. 5 in an open in-use mode.

FIG. 7 is a side view of the retainer of FIG. 5 in a closed in-use mode.

DETAILED DESCRIPTION OF THE INVENTION

Figure 1A:
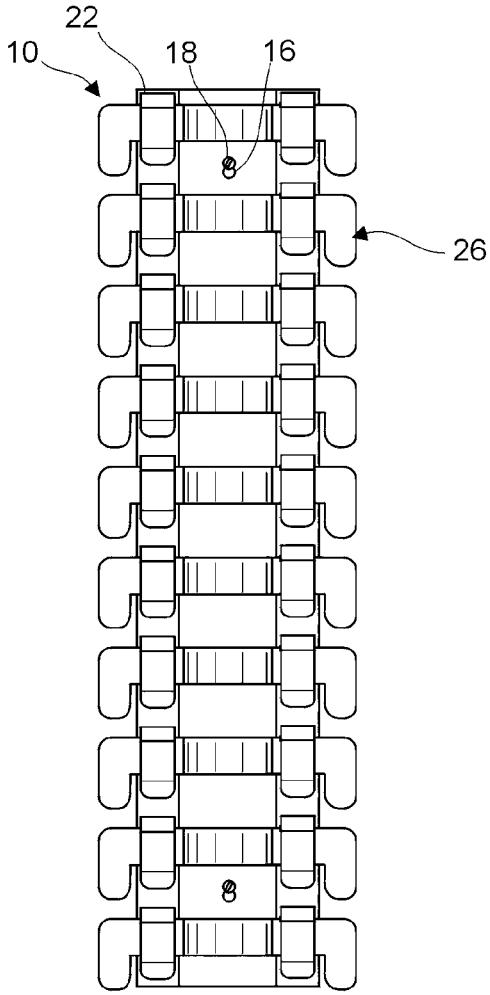
FIG. 1A is a front view of an embodiment of the present invention.
Figure 1C:
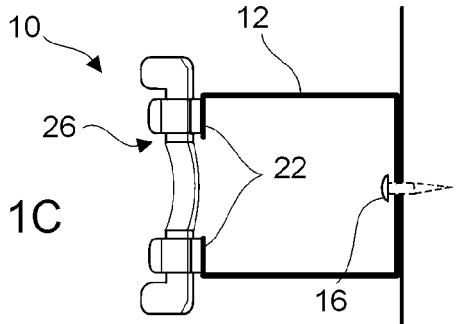
FIG. 1B is a front view of the embodiment in FIG. 1A shown in use.
FIG. 1D shows a staggered version of the retainers used in the invention.
FIG. 1E is a front view of another embodiment of the present invention.
Figure 2A:
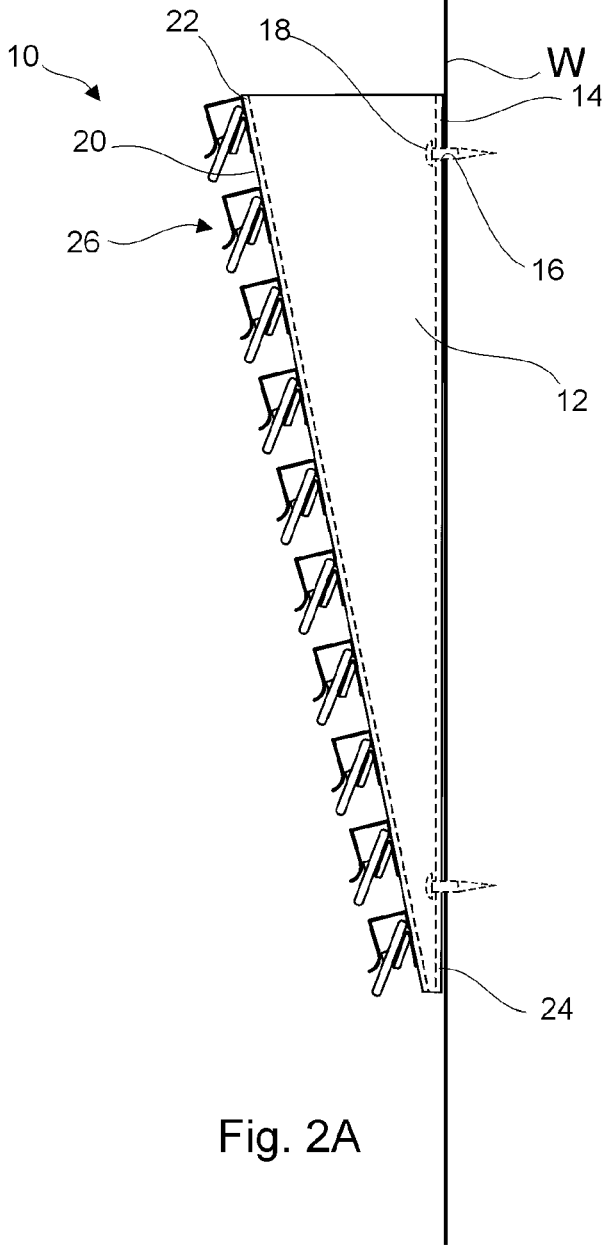
FIG. 2A is a side view of the embodiment in FIG. 1A.

Referring now to the present invention, the clothing hanging device is generally designated by the numerals 10, 100, 200, 300, 400 and 500. Like numbers indicate like parts and are identified accordingly. The clothing hanging device 10 includes a base 12 which is elongated having a back side 14 which can preferably be configured with apertures 16. Fasteners 18, such as screws, can be inserted through the apertures 16 to connect the base 12 to the wall W such that the back side 14 is generally coplanar with respect to the wall W.

A front side 20 of the base 12 can preferably be set at a predetermined angle with respect to the wall W. In this regard, an upper end 22 of the front side 20 is more outwardly disposed from wall W than a lower end 24.

Figure 1B:
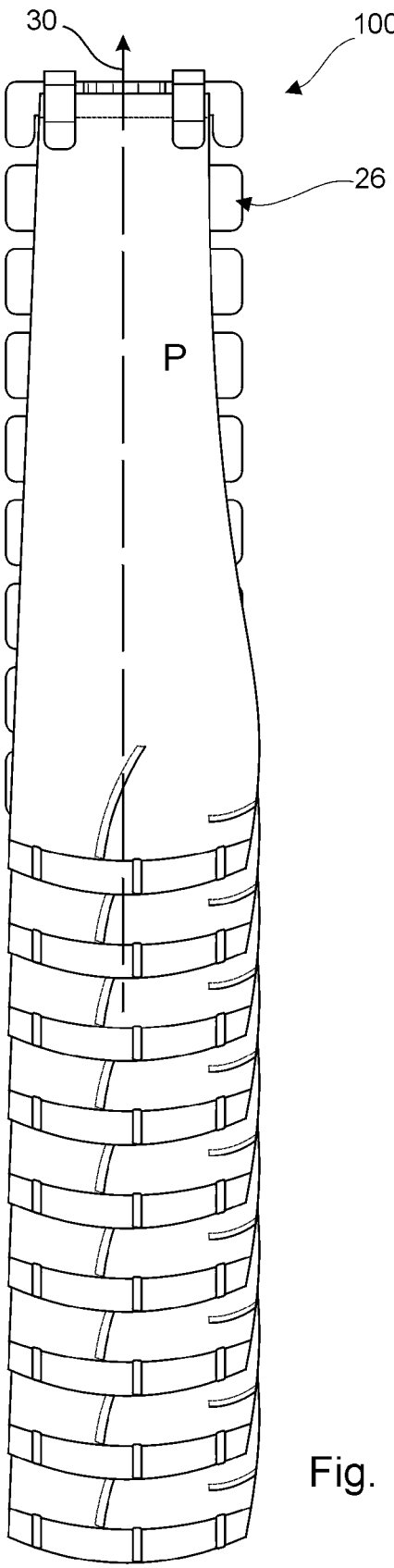
Figure 2B:
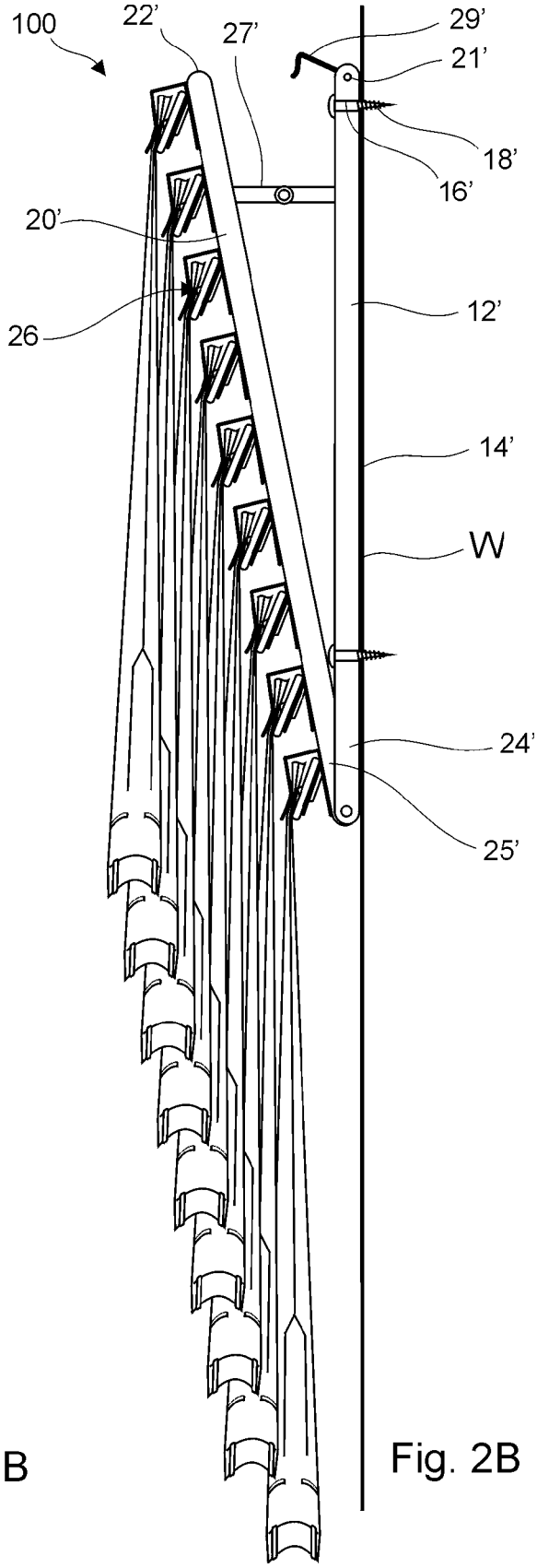
FIG. 2B is a side view of another embodiment of the present invention shown in use.

The front side 20 includes a plurality of retainers 26 which are generally horizontally disposed with respect to a longitudinal axis 30 of the base 12. The retainers 26 releasably retain pants P, for example. It is contemplated that the retainers 26 can retain other types of garments. As seen in FIGS. 1B and 2B, the pants P are spaced from one another in a manner to permit easy access for insertion and removal of thereof without the need to move adjacent hung pants P. Proximate the retention point, each pair generally lies in a plane.

Retainer 26 and its components are illustrated in FIGS. 3-7. The retainer 26 can include a retaining member 32 (a first retaining member) having an outwardly flared side 34 connected to a transverse portion 36 which in turn connects to a side 38. The side 38 mounts to the front side 20 by way of a fastener or other connecting means, for example. A biasing element 40, such as angled spring metal, is operably disposed adjacent the side 34 in a manner to bias toward the same.

A retaining plate 42 (a second retaining member) can have a transverse central portion 44 and side portions 46 (means to displace the first and second retaining members). By way of example, there are shown two laterally spaced retaining members 32 in FIG. 4, with retaining plate 42 disposed therebetween. Also, provided are ridged surfaces 48 extending from the plate 42 which are laterally spaced to generally align with and extend toward the sides 34 of the retaining members 32. The plate 42 is connected to biasing element 40 such that the plate 42 is normally biased into contact with the side 34 of the retaining member 32 as seen in FIG. 5.

Figure 15:
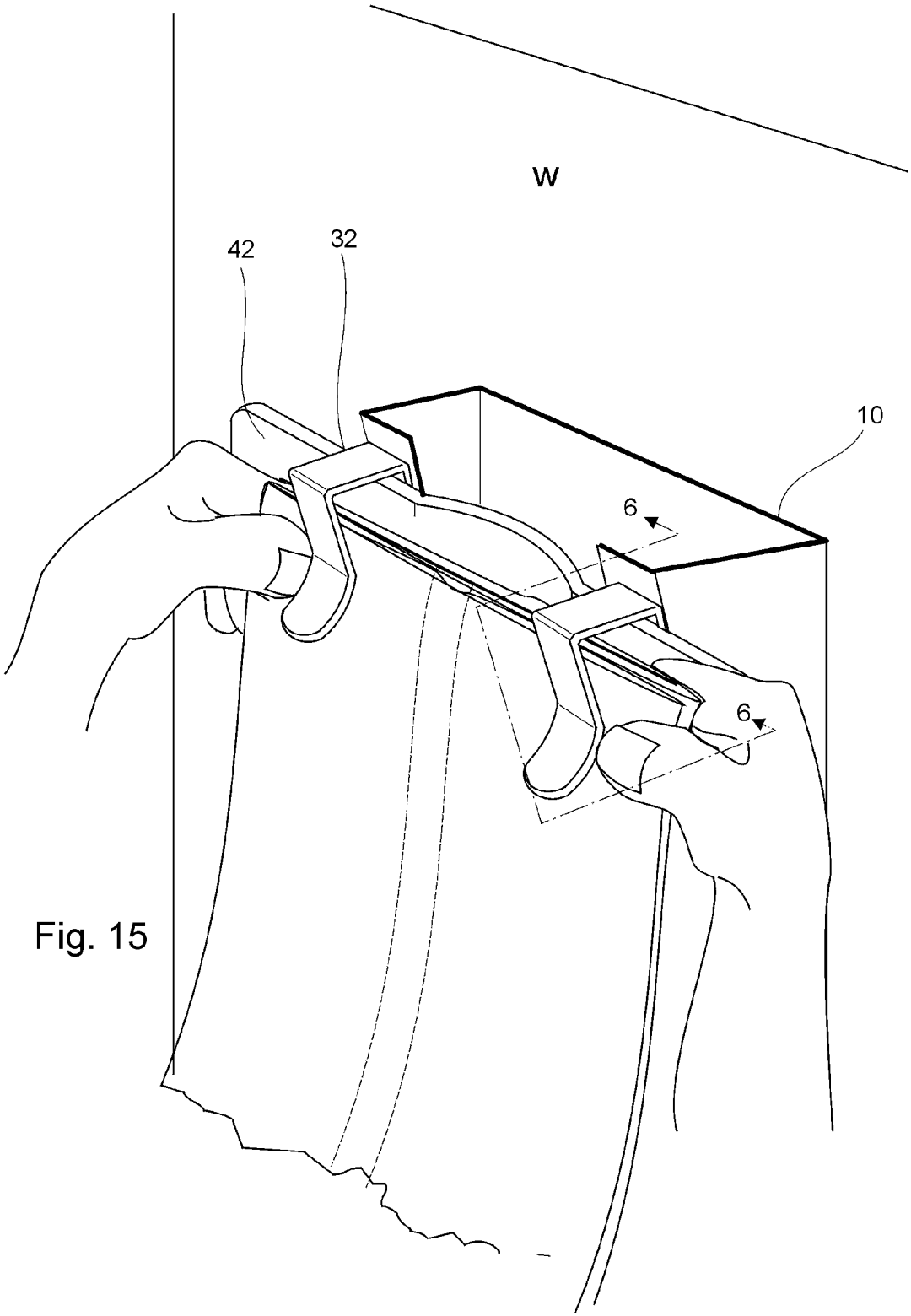
FIG. 15 is a perspective view illustrating the use of an embodiment of the invention.

To insert a garment, such as pants P, one's knuckles can be used to depress the plate 42 as seen in FIG. 15 to permit insertion of the pants P and permit removal by simply pulling down pants P. Once inserted, the biasing element 40 biases the plate 42 with ridged surface 48 against the pants P and into the side 34 as seen in FIG. 6. The pants P are retained through the spring force of the biasing element 40 as shown in FIG. 7. The ridged surface 48 can be smooth to aid in retention of garment, yet permit the release of the garment upon sufficient pulling force being applied thereto. The side portions 46 serve as means for permitting the biasing element 40 to be biased with part of one's hand when applying a force thereto permitting insertion of a garment as seen in FIG. 15 to be hung between the retaining plate 42 and the retaining member 32 with the same hand whereupon the garment can be supportively retained therebetween upon removal of the applied force.

FIG. 2B illustrates another embodiment of the hanging device 100 having base 12'. Here, the base 12' includes a back side 14' hingedly connected to a front side 20' at respective lower ends 24' and 25' with a hinge 27' connecting respective upper ends 21' and 22'. In this embodiment, the front side 20' can be extended from the wall W to permit easy access to the retained garments, or collapsed against the side 14' and retained by a latch mechanism 29' to conserve further space in a closet.

FIGS. 1E, 2C, 16-21 and 26-28 illustrate hanging device 200. Here the retainer 226 can include a retaining member 232 having an outwardly flared side 234 connected to a transverse portion 236 which in turn connects to part of a recessed surface 237 of base 220. The base 220 includes a screw hole 238 through which a screw 240 inserts and connects to a threaded opening 242 in the retaining member 232.

Figure 16:
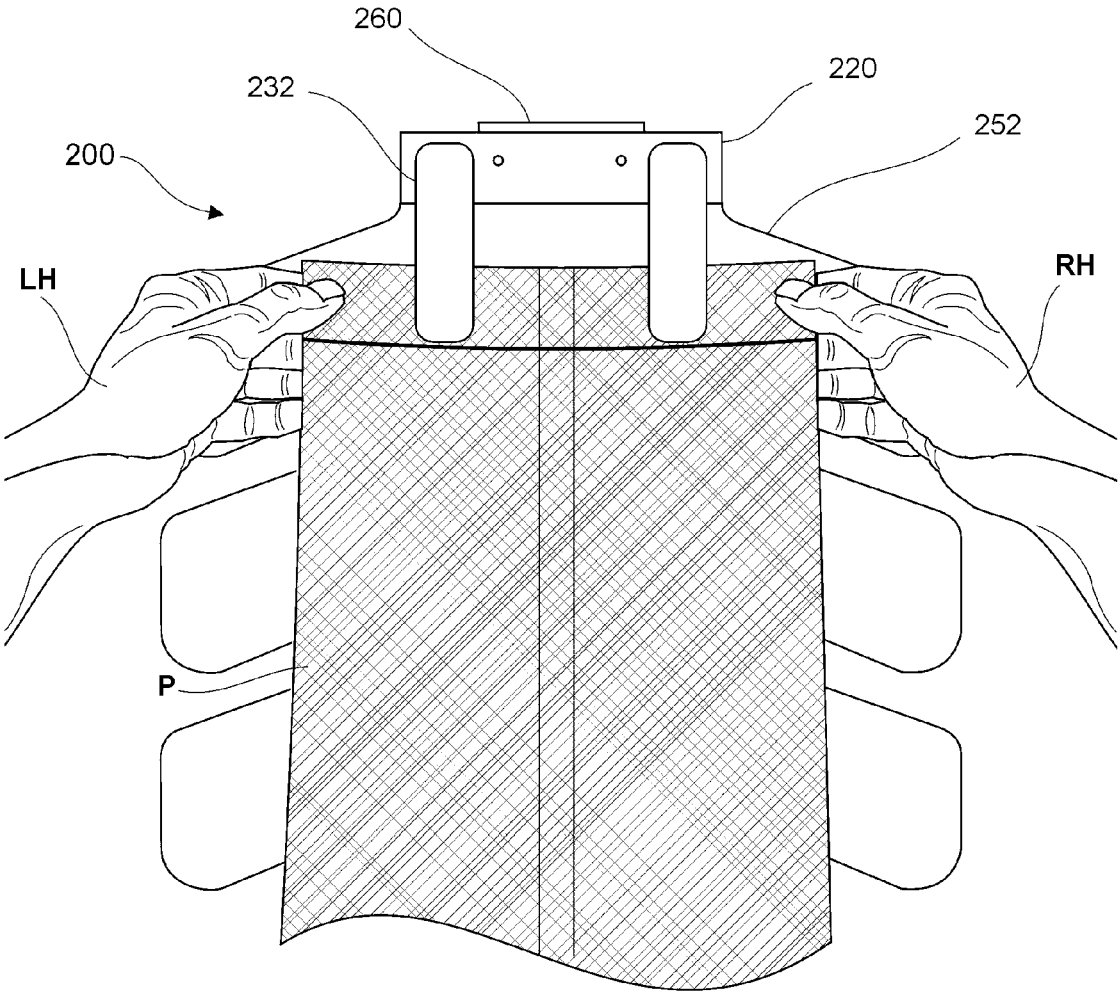
FIG. 16 is a front perspective view illustrating the use of an embodiment of the invention.
Figure 17:
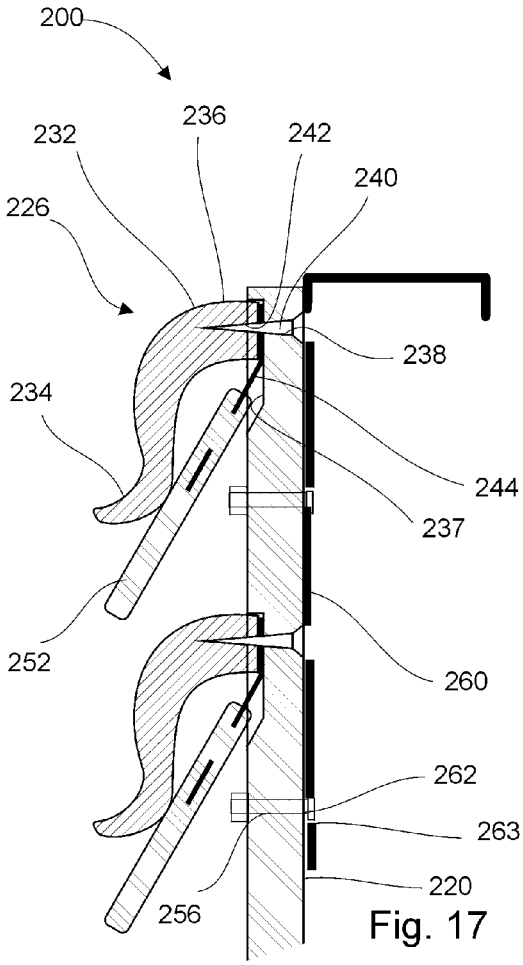
FIG. 17 shows a side view of a portion of the embodiment of FIG. 1E.
Figure 18:
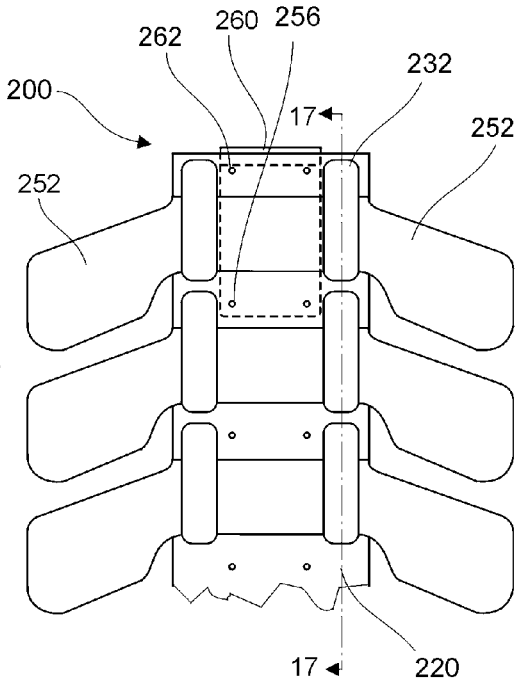
FIG. 18 shows a front view of a portion of the embodiment of FIG. 1E.
Figure 20:
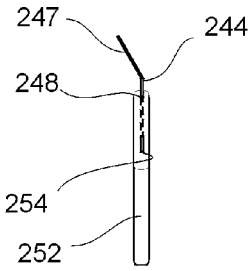
FIG. 20 shows a cross sectional view through line 20-20 of FIG. 19.
Figure 19:
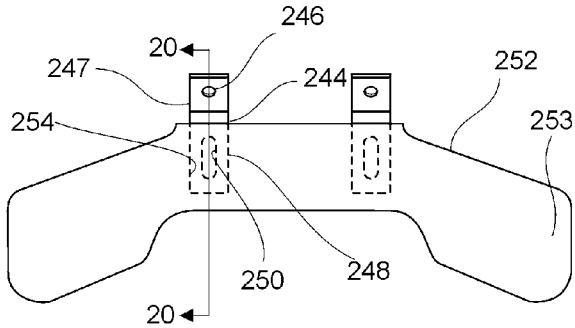
FIG. 19 shows a front view of a part of the embodiment of FIG. 1E.
Figure 21:
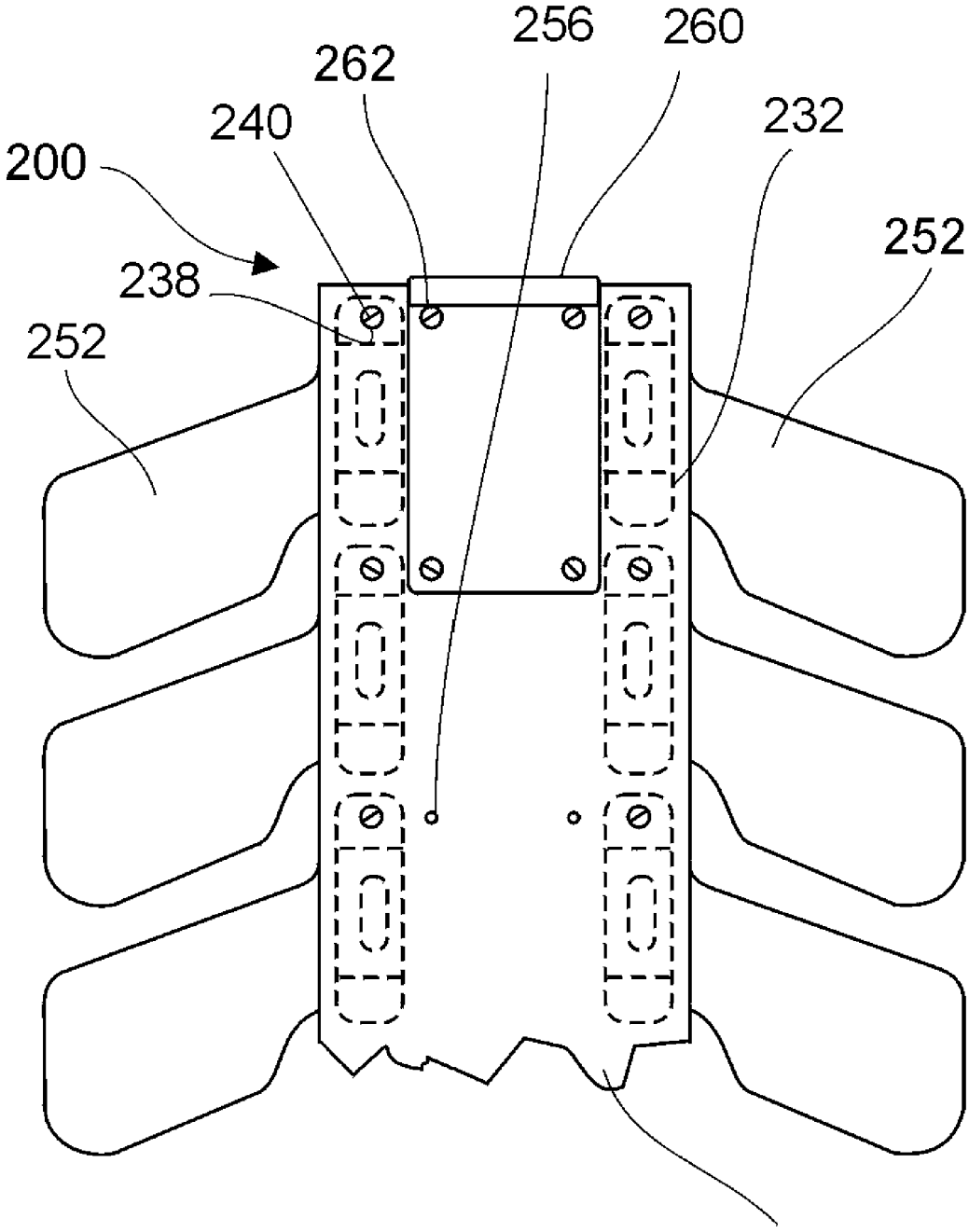
FIG. 21 shows a back view of FIG. 18.

Biasing element 244, such as angled spring metal, is operably disposed adjacent the recessed surface 237 in a manner to bias retaining plate 252 toward the retainer member 232. The biasing element 244 includes an end 247 having a hole 246 which can be co-aligned with screw hole 238 and threaded opening 242 to receive the screw 240 therethrough and lock the biasing element 244 between the retaining member 232 and the base 220. An end 248 of the biasing element 244 includes an opening 250 for use in aiding retention of the same within retaining plate 252. In this regard, the retaining plate 252 includes a slot 254 in which the end 248 is disposed and maintained, which can be for example by a gluing process or the end 248 can be inserted as part of the molding process in forming the retaining plate 252. The opening 250 serves to receive part of the molded material or glue to lock the biasing element 244 to the retaining plate 252. The retaining plate 252 includes ends 253 which serve as means for permitting the biasing element 244 to be biased with part of one's hand when applying a force thereto permitting insertion of a garment as seen in FIG. 16 to be hung between the retaining plate 252 and the retaining member 232 with the same hand whereupon the garment can be supportively retained therebetween upon removal of the applied force. Retaining plate 252 can also include a tab 255 which further aids to support the garment when hung. Retaining plate 252 is otherwise functionally similar as described with respect to the retaining plate 40 above and operates similarly with respect to the retainer member 232 and biasing element 244.

Figure 2C:
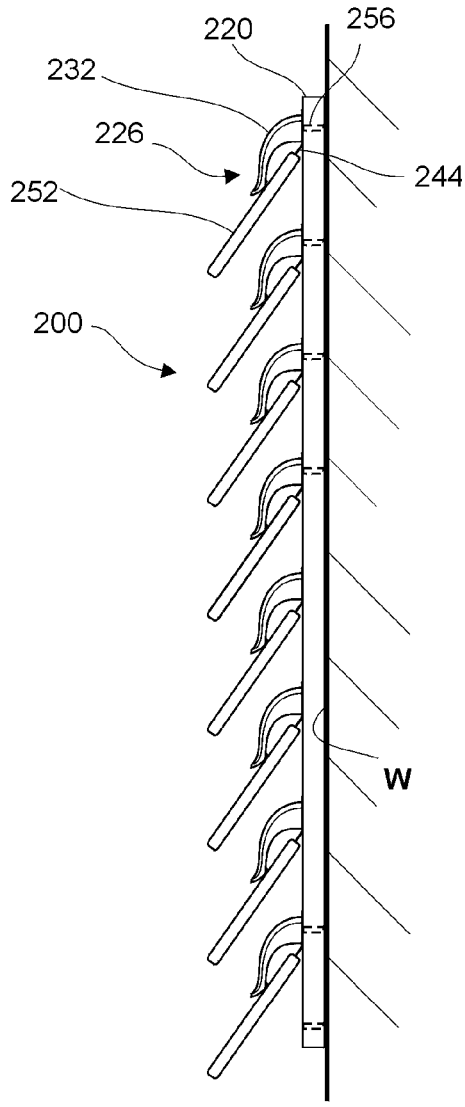
FIG. 2C is a side view of the embodiment shown in FIG. 1E.

FIG. 2C shows the base 220 directly mounted to a wall W. This can be done with the use of connectors, such as screws or wallboard connectors (not shown), which insert through base mounting apertures 256 (seen in FIGS. 18 and 21).

Figure 1D:
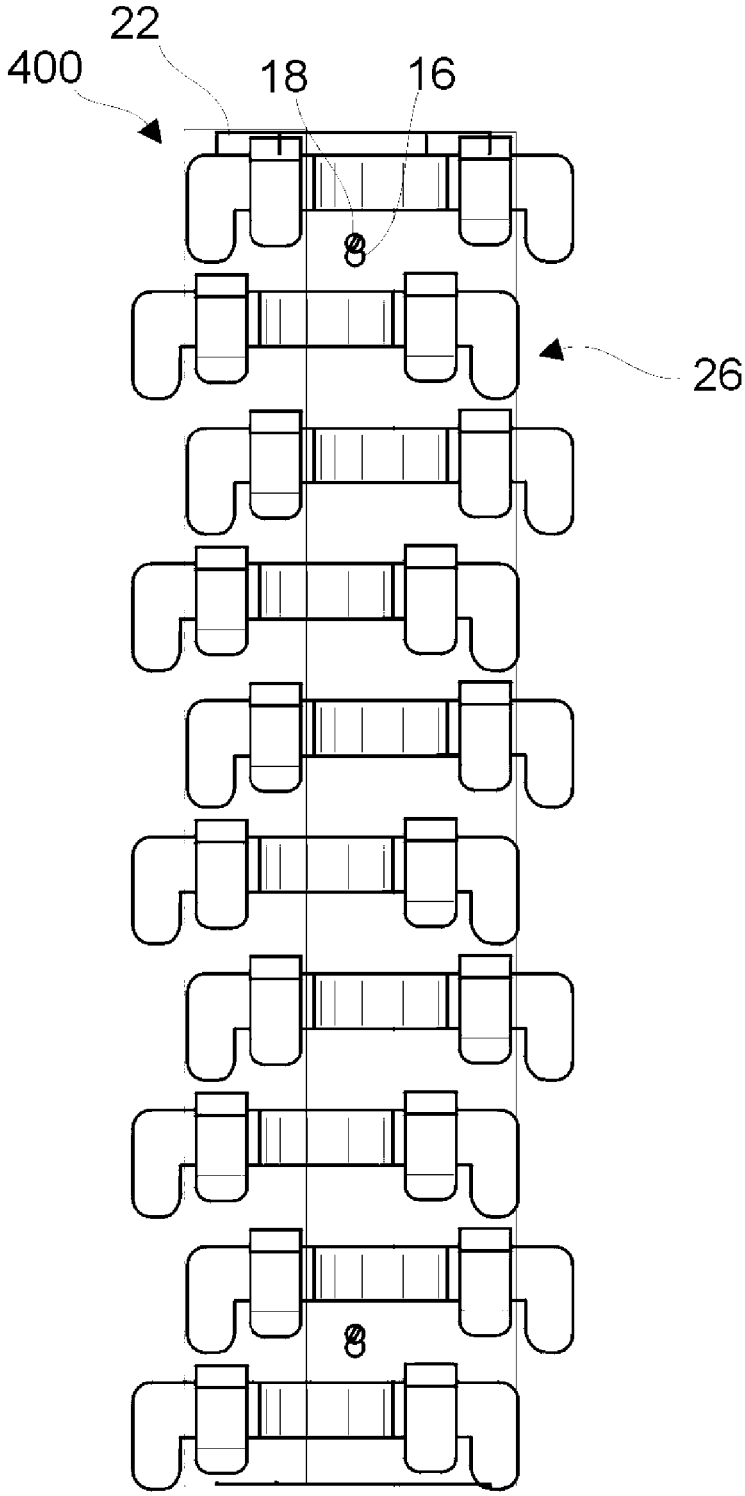
Figure 1E:
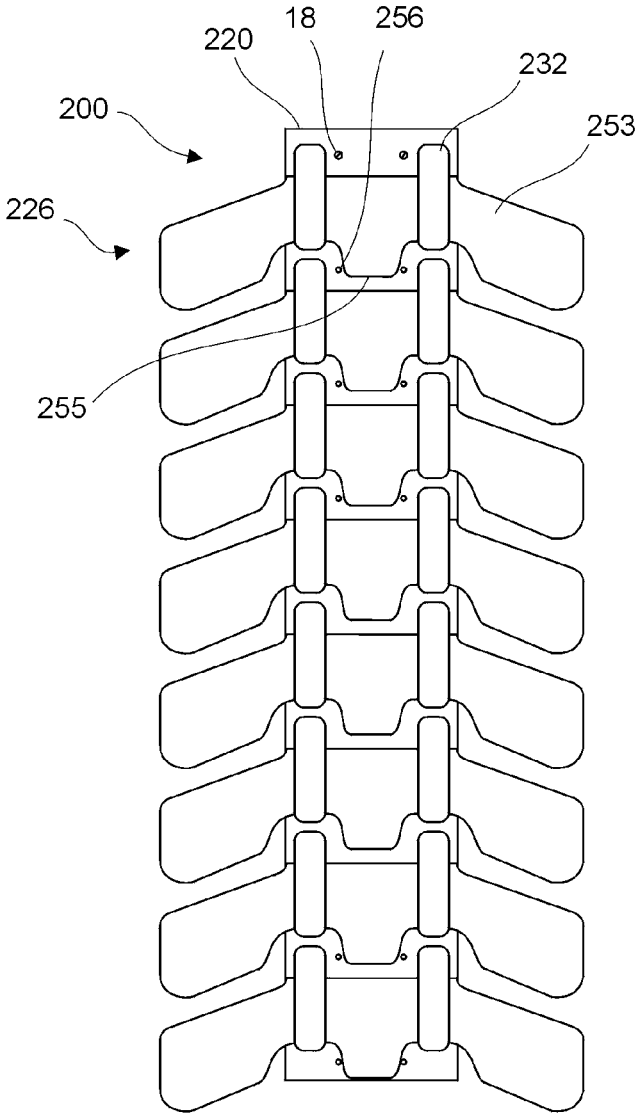
Figure 25:
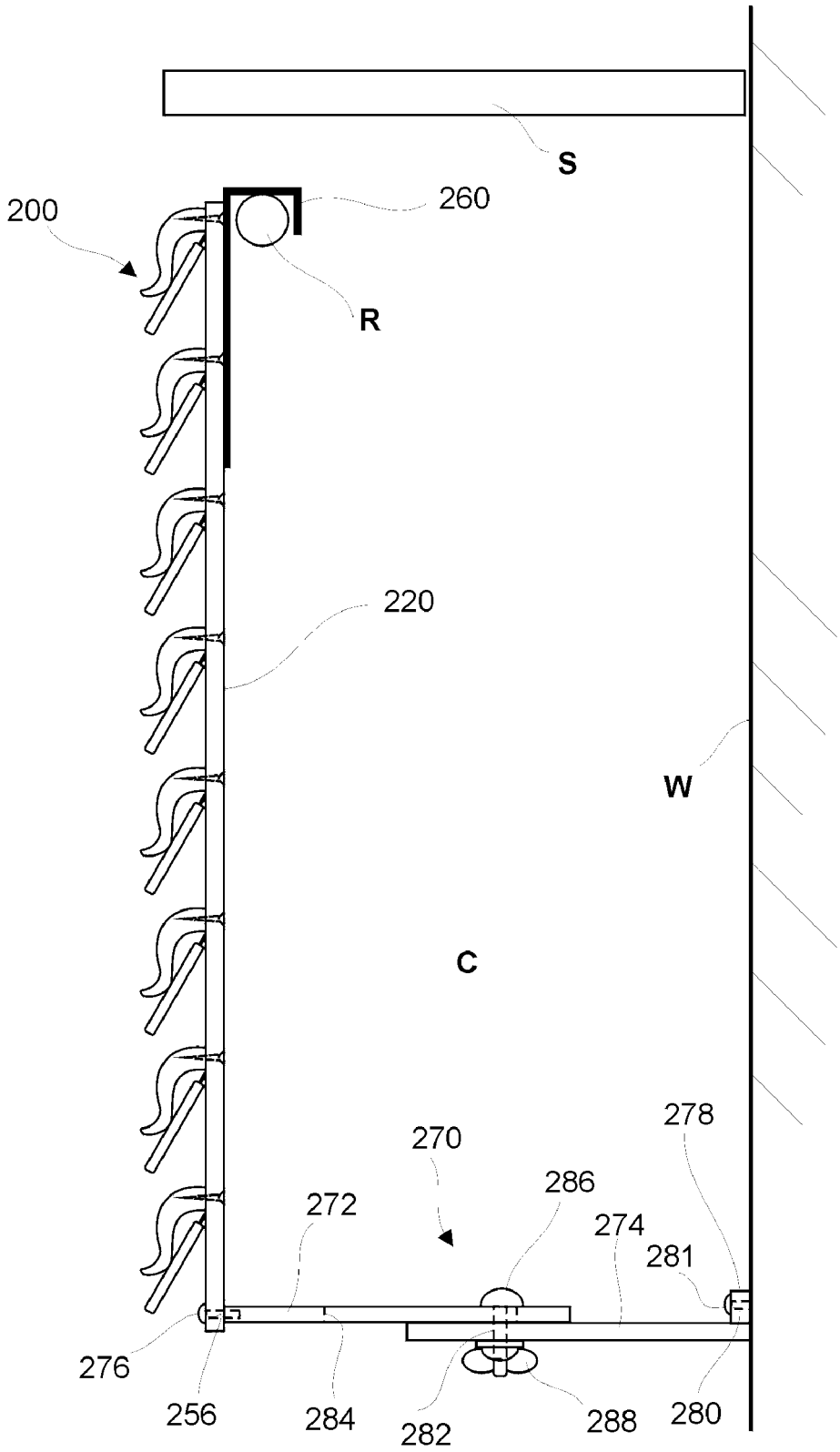
FIG. 25 is a side view illustrating one mode of installation of the embodiment of FIG. 1E in a closet.
Figure 26:
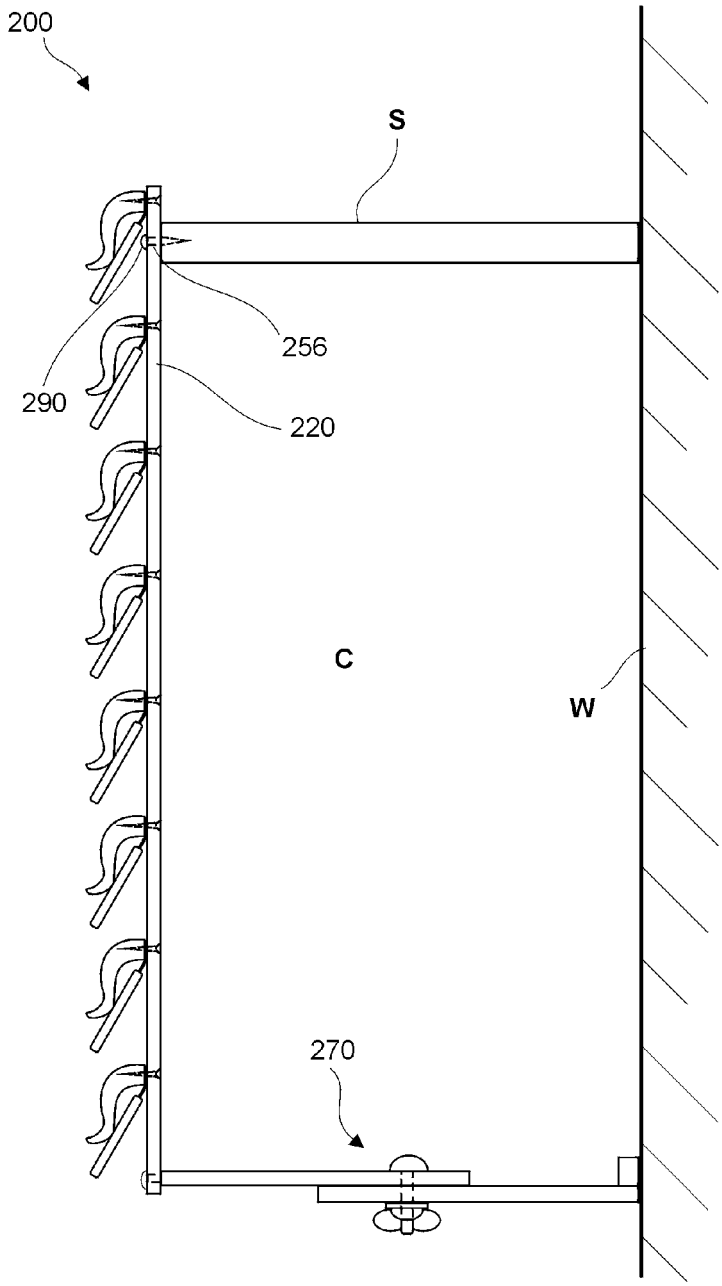
FIG. 26 is a side view illustrating another mode of installation of the embodiment of FIG. 1E in a closet.

FIG. 25 shows one mode of installation of the embodiment of FIG. 1E in a closet C with shelf S and wall W. Several apertures 256 can be used to secure a hook 260 via apertures 263 of hook 260 (see FIG. 17), screw and locking washer nut 262. Here, the hook 260 can be hung on a rod R and a brace 270 can be used to connect the base 220 to the wall W. The brace 270 can include two members 272 and 274, with member 272 secured to base 220 through a screw 276 through aperture 256 and member 274 including a plate 278 having an aperture 280 through which a suitable wall connector 281 can be used to secure member 274 to the wall W. The members 272 and 274 can include cooperating aperture 282 and slot 284 to receive a screw 286 therethrough and nut 288 can be used to lock the members 272 and 274 in place. The slot 284 is elongated and lengthwise to enable a range of depths at which the brace 270 can be installed. FIG. 26 illustrates another mode of installation in a closet C wherein the base 220 mounts directly to the shelf S via a screw 290 through aperture 256.

Figure 27:
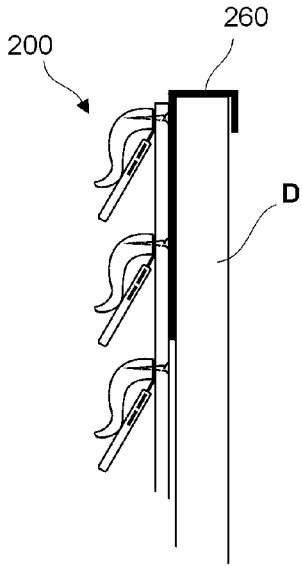
FIG. 27 is a side view illustrating one mode of installation of the embodiment of FIG. 1E on a door.
Figure 28:
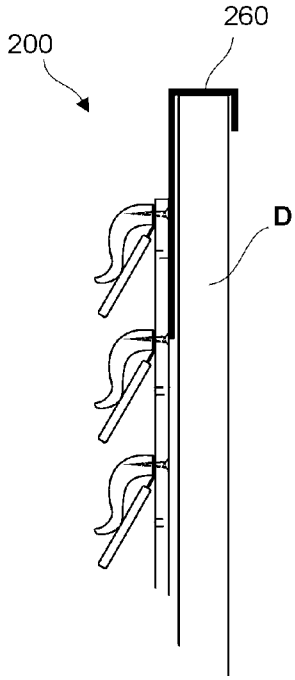
FIG. 28 is a side view illustrating another mode of installation of the embodiment of FIG. 1E on a door.

FIG. 27 illustrates installation of device 200 on a door D using hook 260 and is connected to an upper part of the hook 260. FIG. 28 illustrates another mode of installation on a door D where the base 220 is connected to a lower part of the hook 260.

Figure 22:
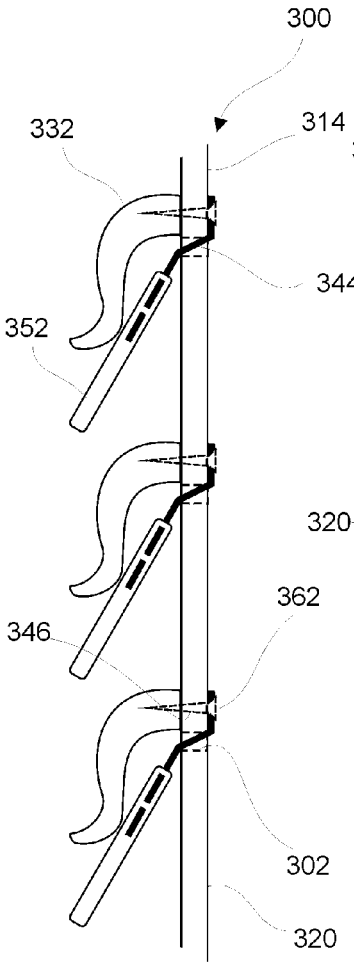
FIG. 22 shows a side view of a portion of still another embodiment.
Figure 23:
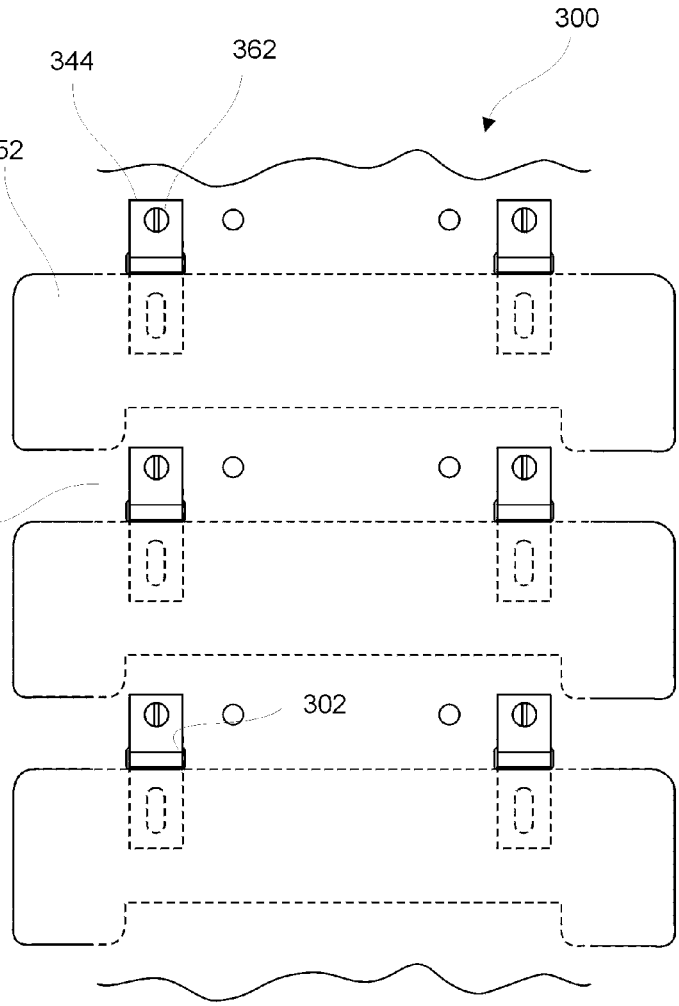
FIG. 23 shows a back view of the portion of FIG. 22.
Figure 24:
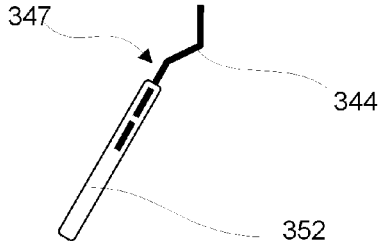
FIG. 24 shows a cross sectional view of a part in FIG. 22.

FIGS. 22-24 illustrate another embodiment 300 which is similar to the embodiment in device 200. A slot 302 is formed in the base 320. The retaining member 332 and retaining plate 352 are similar to retaining member 232 and retaining plate 252. Here, biasing element 344 is longer and includes an angled section 347 to be functionally received through the slot 302. The element 344 is attached to the backside 314 of the base 320 via a screw 362 through opening 346.

FIG. 1D shows hanging device 400 having retainers 26 staggered in relation. In this way, at least a side portion of the articles, such as pants P, can be viewed to aid in their selection without having to move the other hung articles.

As illustrated in FIG. 3, the retaining member 26 has an arcuate central portion 44. This design can permit garments with thicker material and seamed areas to be more easily inserted adjacent the central portion 44.

Figure 8:
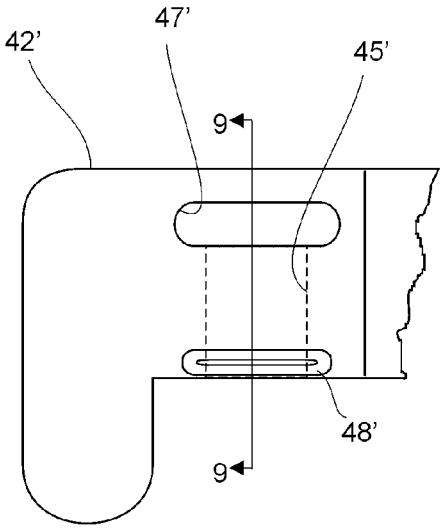
FIG. 8 is a partial view of part of the retainer in FIG. 4.
Figure 9:
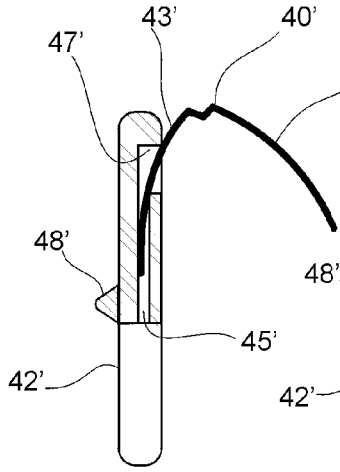
FIG. 9 is a cross-sectional view through line 9-9 in FIG. 8 with a biasing member partially inserted.
Figure 10:
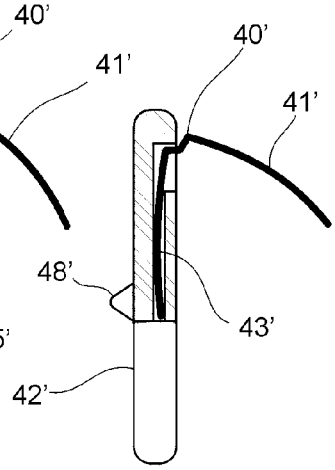
FIG. 10 is another cross-sectional view of FIG. 9 with a biasing member inserted.
Figure 11A:
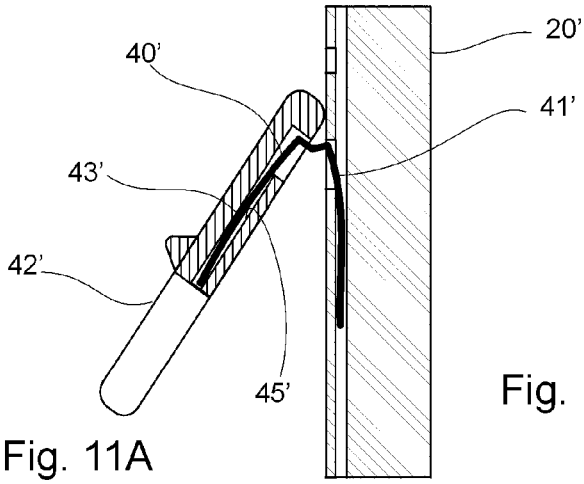
FIG. 11A is a cross-sectional view of another part of a retainer.
Figure 12A:
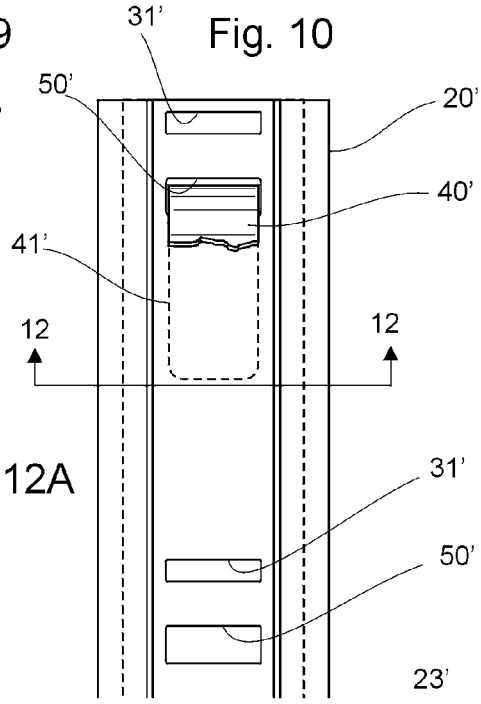
FIG. 12A is a partial front view of a front side of a base with a biasing member inserted therein.
Figure 12C:
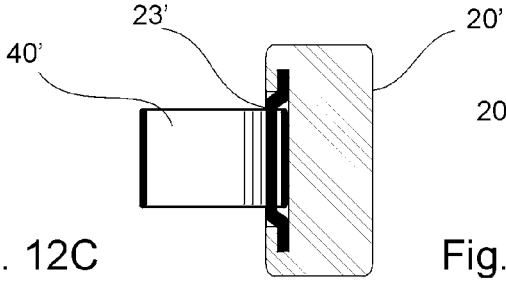
FIG. 12C is a cross-sectional view through line 12-12 in FIG. 12A with a biasing member inserted.
Figure 12B:
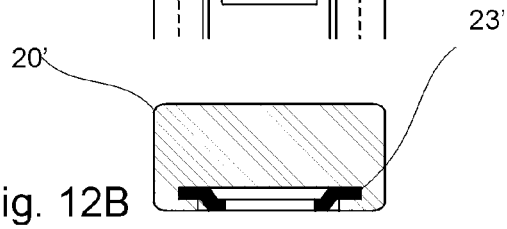
FIG. 12B is a cross-sectional view through line 12-12 in FIG. 12A without a biasing member.
Figure 13B:
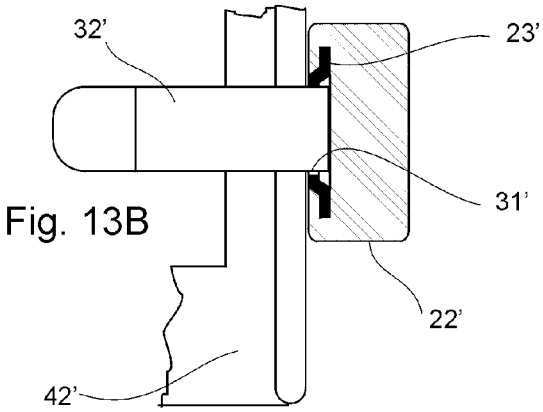
FIG. 13B is partial top view of the invention taken through line 13B-13B shown in FIG. 13A.
Figure 13A:
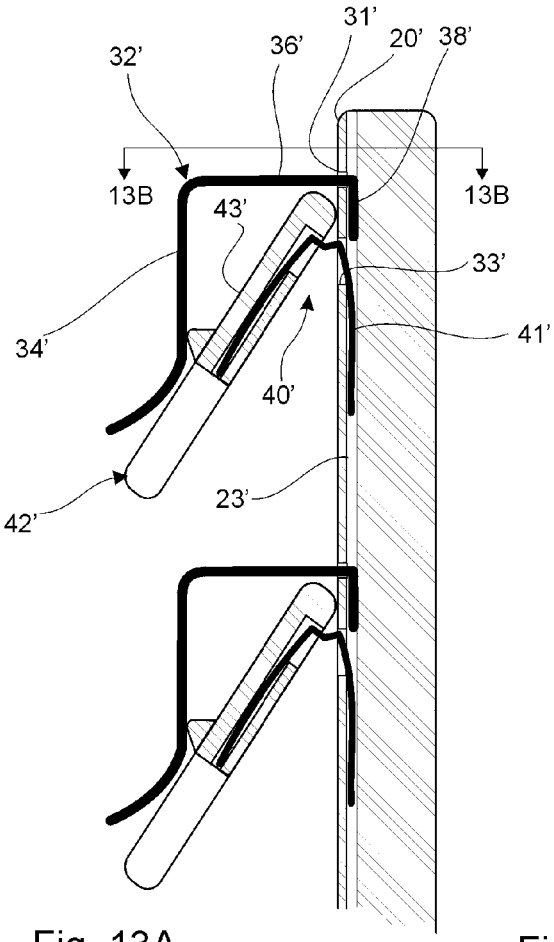
FIG. 13A is a cross-sectional view through part of an embodiment of retainers of the invention.

In FIG. 13A, the retaining member 32' includes a short side 38' which inserts into a longitudinal channel 23' cut into the front side 20' through a groove 31' in the front side 20' to snap and lock the retaining member 32' in place. Longitudinally displaced from and below the groove 23' is another groove 33'. As seen in FIGS. 8 and 13 A, a spring 40' is employed with one side 41' disposed in the channel 23' and another side 43' disposed in a slot 45' of plate 42' through groove 47'. The shape of the springs 40, 40' can vary so long as the intended use with the invention is accomplished.

Figure 14B:
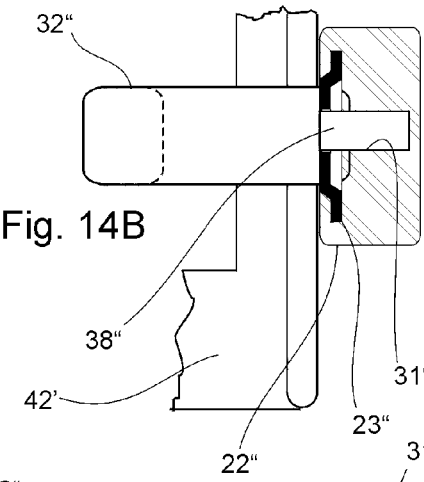
FIG. 14B is partial top view of the invention taken through line 14B-14B shown in FIG. 14A.
Figure 14A:
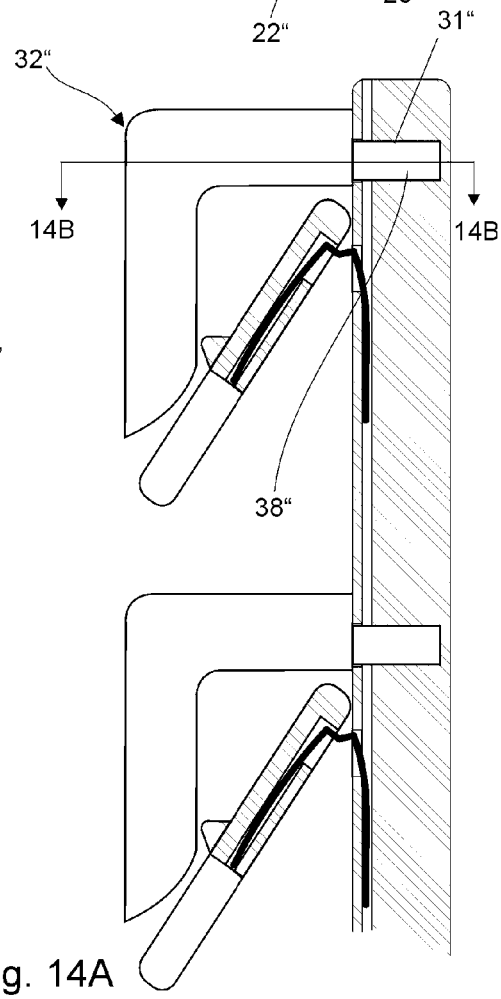
FIG. 14A is a cross-sectional view through part of an embodiment of retainers of the invention.

FIGS. 14A and 14B show another retaining member 32". The member 32" includes a post 38" which can be press fit into a bore 31" of front side 20" and is configured to receive the post 38" in such a manner.

Figure 29:
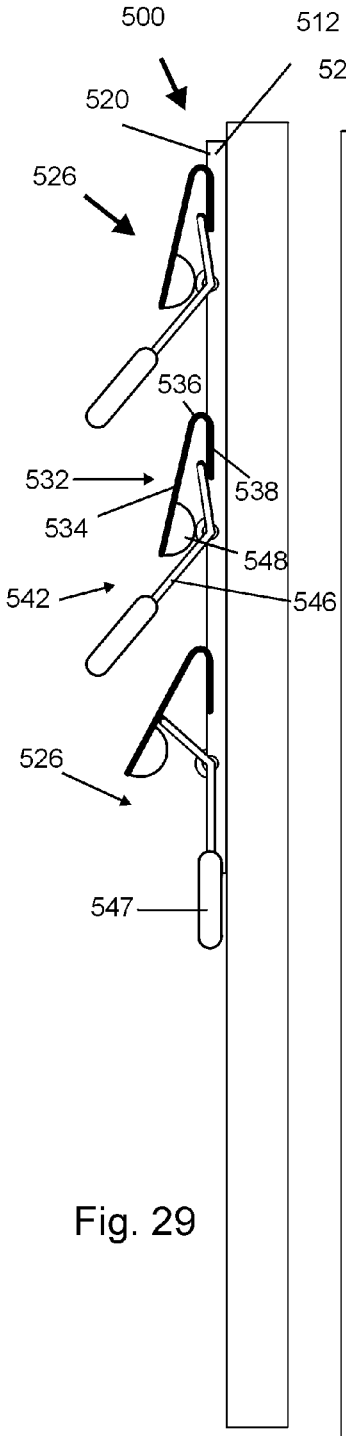
FIG. 29 is a side view of yet another embodiment of the invention.
Figure 30:
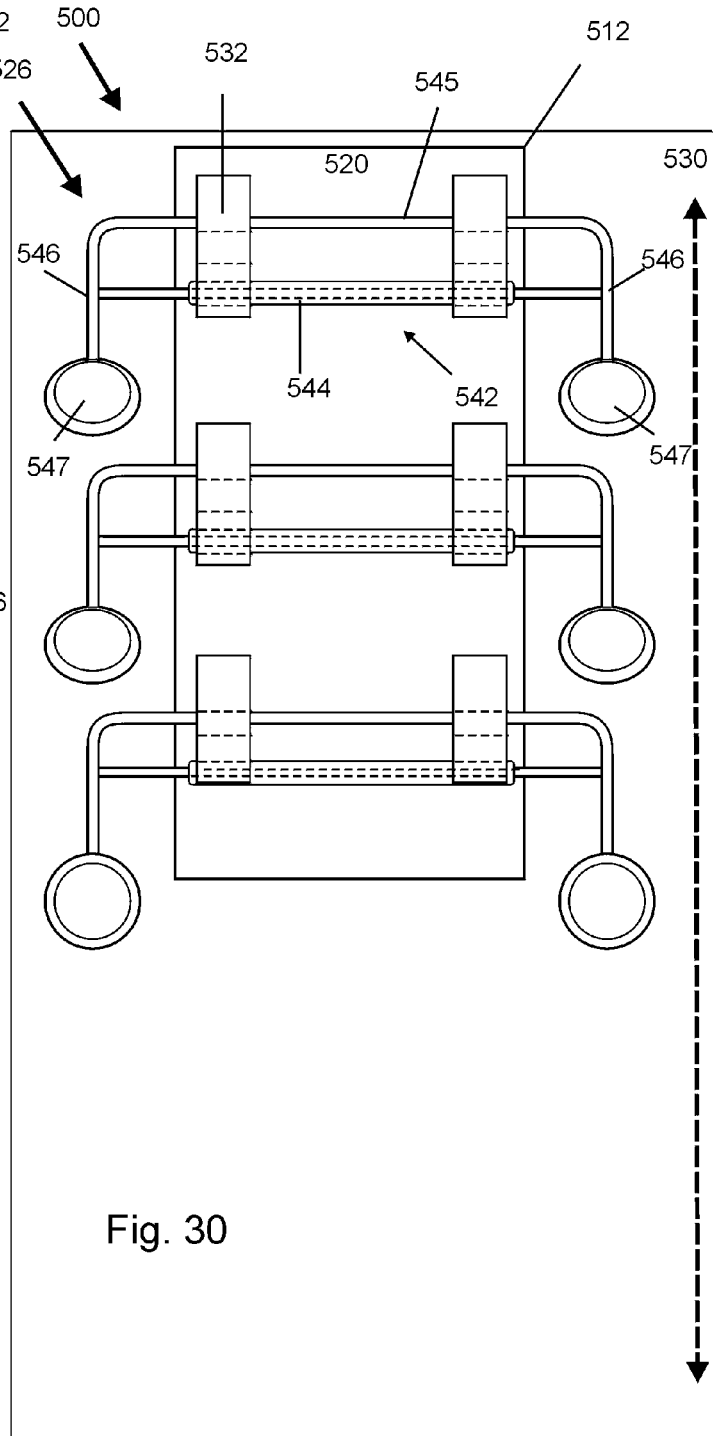
FIG. 30 is a front view of the embodiment of FIG. 30.
Figure 31:
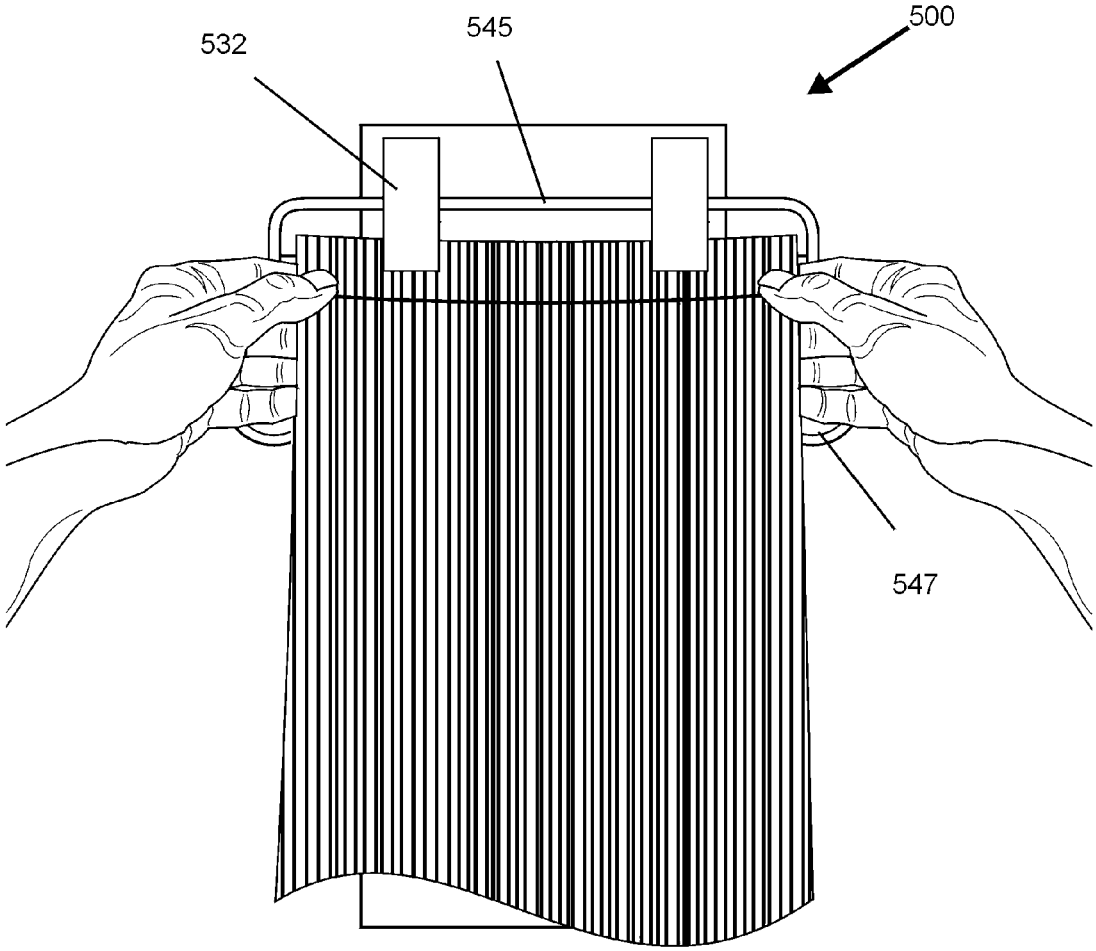
FIG. 31 is a front view illustrating use of the embodiment shown in FIG. 30.

FIGS. 29-31 disclose yet another embodiment which is generally referred to by the numeral 500. Similarly, a front side 520 of a base 512 includes a plurality of retainers 526 which are generally horizontally disposed with respect to a longitudinal axis 530 of the base 512. The retainers 526 operate to retain articles in similar way to that of the prior embodiments with a few modifications. Each retainer 526 can include a pair of first retaining members 532 each having an outwardly disposed side 534 connected to a transverse portion 536 which in turn connects to an inwardly disposed side 538. The inwardly disposed side 538 mounts to the front side 520 by way of a fastener or other connecting means, for example. The retaining member 532 can preferably be made of biasing material, such as angled spring metal and are bent to be maintained in a predetermined angle.

A retaining bar 542 (a second retaining member) has a first transverse bar portion 544 which is pivotally mounted to the base 512 and a second transverse bar portion 545 having side portions 546 which interconnect the first transverse bar portion 544. The side portions 546 each include an end plate 547. Each of the side portions 546 are bent at a predetermined angle as seen in FIG. 29. The retaining bar 542 provides the means to displace the first and second retaining members. There are shown two laterally spaced retaining members 532 in each retainer 526. A ridged surface 548 is formed on an end of the outwardly disposed side 534 and contacts the first transverse bar portion 544 when the retaining members 532 are in their normal predetermined position as seen in FIG. 29.

To insert a garment, the plate 547 of the lower retainer 526 can be depressed which in turn causes the second transverse bar portion 545 to impinge upon the outwardly disposed side 534 overcoming the spring constant and displace the ridged surface 548 from the first transverse bar portion 544. This permits insertion and removal of the garment through this mechanism. Once inserted, pressure on the plates 547 can be removed and the natural bias of the retaining members 532 biases ridged surfaces 548 against the pants P and into the first transverse bar portion 544 to retain the garment as seen in FIG. 31. This embodiment also provides means for permitting part of one's hand to apply a force and to permit insertion of a garment whereupon removal of such force, the garment can be supportively retained by the retainer 526.

By so providing the above described elements, the instant invention includes means for simultaneously permitting the biasing means to be compressed with part of one's hand, e.g., with one's knuckles, while permitting insertion of a garment, e.g., with one's fingers, between the retaining members with the same hand, as seen in FIG. 15. Where upon such insertion, the garment can be supportively retained between and by the retaining members. For removal of the garment, one only need to grasp the desired garment and pull downward to overcome the spring force constant of the biasing element 40. While the present invention has described the hanging of garments, it is understood that the invention can be useful for other articles such as architectural plans or the like for example.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A hanging device, which includes:

a base having a back side and a front side;

a first retaining member connected to said front side and extending outward therefrom;

a second retaining member disposed adjacent said first retaining member;

first means for biasing said first retaining member toward said second retaining member; and first means extending laterally from one of said first retaining member and said second retaining member in a manner to permit separate access thereto enabling actuation of said biasing means by application of force applied thereto to displace said retaining members and for permitting said biasing means to be biased with part of one's hand when applying a force against said permitting means causing displacement of said first retaining member from said second retaining member and permitting insertion of an article to be hung between said retaining members with the same hand whereupon the article can be supportively retained between and by said retaining members upon removal of said force from said first permitting means.

2. The hanging device of claim 1, wherein said base is elongated having a vertically disposed with respect to a horizontal floor support surface.

3. The hanging device of claim 1, wherein said first retaining member includes said first biasing means.

4. The hanging device of claim 3, wherein said first retaining member is a spring.

5. The hanging device of claim 1, wherein said second retaining member is rigid.

6. The hanging device of claim 1, wherein at least one of said retaining members includes a ridged surface adjacent a point of contact therebetween.

7. The hanging device of claim 1, wherein said first permitting means is pivotally connected to said base.

8. The hanging device of claim 3, wherein said first biasing means includes an angled-spring metal.

9. The hanging device of claim 1, which includes a third retaining member connected to said front side and extending outward therefrom and longitudinally spaced from said first retaining member, a fourth retaining member disposed adjacent said third retaining member, second means for biasing said third retaining member toward said fourth retaining member, and second means extending laterally from one of said third retaining member and said fourth retaining member in a manner to permit separate access thereto enabling actuation of said biasing means by application of force applied thereto to displace said retaining members an for permitting said second biasing means to be biased with part of one's hand when applying a force against said permitting means causing displacement of said third retaining member from said fourth retaining member and permitting insertion of an article to be hung between said third and fourth retaining members with the same hand whereupon the article can be supportively retained between and by said retaining members upon removal of said force from said second permitting means.

10. The hanging device of claim 9, wherein said base is elongated vertically disposed with respect to a horizontal floor support surface.

11. The hanging device of claim 9, wherein said third retaining member includes said second biasing means.

12. The hanging device of claim 11, wherein said third retaining member is a spring.

13. The hanging device of claim 9, wherein said forth retaining member is rigid.

14. The hanging device of claim 9, wherein at least one of said retaining members includes a ridged surface adjacent a point of contact therebetween.

15. The hanging device of claim 9, wherein said permitting means are pivotally connected to said base.

16. The hanging device of claim 9, wherein said second biasing means includes an angled spring metal.

* * * * *